US006177663B1

(12) United States Patent
Kula

(10) Patent No.: US 6,177,663 B1
(45) Date of Patent: Jan. 23, 2001

(54) FOOD MOLD FOR MICROWAVE OVEN USE

(76) Inventor: Gregory Michael Kula, 725 Villa Rd. Apt. 123, Springfield, OH (US) 45503

( * ) Notice: Under 35 U.S.C. 154(b), the term of this patent shall be extended for 0 days.

(21) Appl. No.: 09/302,192

(22) Filed: Apr. 29, 1999

(51) Int. Cl.[7] ..... H05B 6/80

(52) U.S. Cl. ..... 219/725; 99/DIG. 14; 99/410; 99/413; 219/732; 426/76; 426/107

(58) Field of Search ..... 219/725, 726, 219/727, 728, 730, 732, 733; 99/419, 443, 451; 426/107, 76

(56) References Cited

U.S. PATENT DOCUMENTS

| | | | | |
|---|---|---|---|---|
| 4,416,906 | * | 11/1983 | Watkins | 426/107 |
| 4,491,601 | * | 1/1985 | Bernal | 426/421 |
| 4,781,109 | * | 11/1988 | Wiebe, Jr. et al. | 99/483 |
| 4,845,327 | * | 7/1989 | Iwabuchi et al. | 219/754 |
| 4,876,428 | * | 10/1989 | Petcavich | 219/732 |
| 4,938,975 | * | 7/1990 | Waller | 426/91 |
| 4,966,781 | * | 10/1990 | Artzer | 426/280 |
| 5,046,633 | * | 9/1991 | Chung | 220/407 |
| 5,280,150 | * | 1/1994 | Arai et al. | 219/725 |
| 5,400,704 | * | 3/1995 | Huston | 99/450 |
| 5,431,092 | * | 7/1995 | Guillory | 99/410 |
| 5,893,320 | * | 4/1999 | Demaree | 99/419 |
| 5,976,585 | * | 11/1999 | Gagliardi et al. | 426/76 |

* cited by examiner

*Primary Examiner*—Teresa Walberg
*Assistant Examiner*—Jeffrey Pwu

(57) ABSTRACT

A molding tube for the production of a bread product formed around a skewer (37). The skewer (37) is used in piercing ingredients used for flavor. The skewer (37) then organizes where chosen ingredient flavors will appear in the final food product. The skewer (37) may also used as a utensil in eating the final food product. One embodiment of the invention is the replacement of skewer (37) with a assembly consisting of a store bought candy stick (50) which has been connected to a pointed portion (43) via a post (66) and a pointed end (79). All embodiments of the present invention require support for skewer (37). The support may come from an insert (56) located in the uppermost opening of molding tube (61). The insert (56) has a fossa (57) or a plurality of fossa (57). Skewer (37) is supported by inserting skewer (37) into a compatible fossa (57). The insert (56) also has a vent (45) or a plurality of vent (45) which allow expanding gases to escape molding tube (61) during cooking. Alternatively the skewer (37) can be supported by a one piece disc (59) which has a recess (60) located in the center of disc (59). The skewer (37) is supported when it is inserted into recess (60). The disc (59) rests at the bottom end of the molding tube (61). Molding tube (61) in all embodiments is held in an upright position by a base (58).

19 Claims, 19 Drawing Sheets

FOOD MOLD FOR MICROWAVE OVEN USE

FIELD OF INVENTION

The present invention relates to a cooking device, specifically to such device which mold a bread product around a skewer during cooking of the product which optionally may contain skewered ingredients embedded in the batter.

DESCRIPTION OF PRIOR ART

Fast foods have become common in our society in part to help people better manage their time. Fat and caloric content of the fast food item are also becoming increasingly important. Corndogs, also called hot dogs on a stick, are an example of a fast food item. They are a hot-dog or sausage skewered and dipped in batter, not limited to cornbread batter. The assembly is then cooked so that the batter adheres to the skewered meat. They help busy people eat breakfast because they can be prepared prior to breakfast and reheated when needed. Their convenience also comes in part from the use of the skewer. The inclusion of a skewer eliminates the need for a plate or flat surface to cut food into sufficiently small pieces to eat. A traditional pancake and sausage breakfast often needs a flat surface for cutting, so is less convenient than the skewered corndog.

Corndogs are also more convenient than pancakes because corndogs do not need to be flipped with a spatula to ensure even cooking. This eliminates the opportunity to dirty the surrounding cooking area, which is possible when flipping a pancake.

The skewer that comes with the corndog is easier to use than a fork. The skewer unlike the fork does not require the person eating to repeatedly pierce the food with a utensil. Food-utensil contact was already achieved when the skewer was inserted into the filling portion before cooking. The convenience of a skewer can then benefit a person walking or driving to work, allowing then to focus their vision on the changing environment. Skewers can also help a care giver give more eating independence to the people they care for. For example, a parent does not need to cut and possibly feed a young child unfamiliar with how to use a fork. A care giver also does not need to cut and feed food to a person who has difficulty holding a fork for medical reasons.

Corndogs or hot-dogs on a stick are more convenient than pancakes served with sausage, but corndogs are fried and this often make them less healthy than pancakes and sausage. For some people the convenience of a corndog does not outweigh the fat grams and calories it brings, so they opt for other alternatives. These people are looking for the convenience of a corndog, but with no excess calories from frying oil. One example of a nonalternative is U.S. Pat. No. 4,483,240 to Dinh (1984), because this patent describes the frying of a fast food item. Frying is also found in U.S. Pat. No. 5,865,103 to MacGeorge et al (1999).

Another disadvantage of U.S. Pat. No. 4,483,240 is the lack of a skewer being used through preparation and consumption. Italian patent 264,521 to Pagano (1929) also does not offer the convenience of eating a skewered product on a stick.

If the corndog alternative is a bun which is filled with filling later, a detraction to their convenience is the separate preparation of the filling and bun. Patents which are known to include this downside are U.S. Pat. No. 13,455 to Lenier et al (1912), U.S. Pat. No. 1,879,146 of Estrin (1932), U.S. Pat. No. 2,125,589 to Shuman (1938), U.S. Pat. No. 2,267,213 to Newcom (1941), U.S. Pat. No. 3,424,076 to Bernatz et al (1969), U.S. Pat. No. 3,466,999 to Yanex-Pastor et al (1969), U.S. Pat. No. 4,212,234 to DeCourcy (1980), U.S. Pat. No. 4,542,684 to Cantrell (1985), U.S. Pat. No. 4,817,513 to Carbon (1989), and U.S. Pat. No. 5,528,981 to Pettit (1996).

Another alternative to a fried corndog which also used the separate preparation of filling is U.S. Pat. No. 5,359,924 to Roberts et al (1994). The patent includes the convenience of using a skewer during parts of preparation and during consumption. It can also be described as providing the convenience of a corndog but with less calories from frying oil. Both features appeal to people who want the convenience of a corndog but not the heath drawbacks.

The patent describes one or a plurality of cylinders for receiving a skewered cooked sausage. The cylinder is then filled with a pancake batter thick enough to hold the sausage and stick in upright position. The cylinders is then submerged in a hot oil for a few minutes or heated in an electrical appliance to cook the batter and produce a breakfast on stick. By preventing food from direct contact with frying oils U.S. Pat. No. 5,359,924 accomplished an object to provide a breakfast item such as a sausage on a stick embedded in a pancake batter which allows the sausage to be cooked in the batter and free of oils and fats. The decrease in oils and fats makes the item more appealing to consumers wishing to cut back on cholesterol and calories while enjoying the convenience of a breakfast item of this type.

A detraction from U.S. Pat. No. 5,359,924 health benefit is the requirement that the batter be thick enough to support the skewered sausage in an upright position. With some of today's commercial pancake mixes it is not possible to follow pancake manufacture instructions for preparation of batter and obtain the desired result of thick enough batter needed in U.S. Pat. No. 5,359,924. In order to obtain the thick enough batter, more mix and thus more calories would be needed to add to the batter. The altering of manufacturer directions can leave a consumer unknowing of the caloric content of the food they are preparing. This is not healthy for people who need to watch their caloric intake.

Convenience was another goal of U.S. Pat. No. 5,359,924. For office use the requirement of a fryer or separate electrical appliance is a disadvantage. Some consumers might find difficulty using U.S. Pat. No. 5,359,924 in a workplace that does not have adequate ventilation for frying or facilities to store fryer or its waste. Storing an electrical appliance with the physical dimensions described in U.S. Pat. No. 5,359,924 within the workplace desk or locker can also be difficult.

Convenience is further compromised in U.S. Pat. No. 5,359,924 by requiring that the sausage be precooked before being coated with batter and cooked. This requires additional time not only in cooking, but also cleaning of materials used in cooking.

Objects and Advantages

Accordingly, several objects and advantages of my invention of a food mold for microwave use to produce a batter product on a stick or a batter wrapped filling on a stick are:

(a) to provide a cooking device with a support to hold a skewer in an upright state.

(b) to provide a cooking device with a support to hold the skewer so that batter intended to cover the skewer and filling does not have to be thick enough support the skewer, thereby allowing batter to be prepared according to batter manufacturer directions and making clear the caloric content of the batter.

(c) to provide a cooking device that uses microwave energy to evenly cook all contents of the apparatus at the same time in the same container.

(d) to provide a cooking device that can be used with the same accessibility as a microwave.

(e) to provide a cooking device that produces a food item capable of being eaten without the use of a flat surface for cutting and or utensils such as fork or knife.

(f) to provide a cooking device that can be easily stored in a workplace desk, refrigerator, or locker.

(g) to provide a cooking device that cooks all ingredients at the same time in the same container without the use of a fryer or a electric heating coil.

(h) to provide a cooking device that does not transfer calories to food product from cooking oils.

(i) to provide a cooking device that can organize the ingredient flavors of the product formed.

(j) to provide a piercing device with a detachable end.

Still further objects and advantages will become apparent from a consideration of the ensuing description and drawings.

Figure 1:
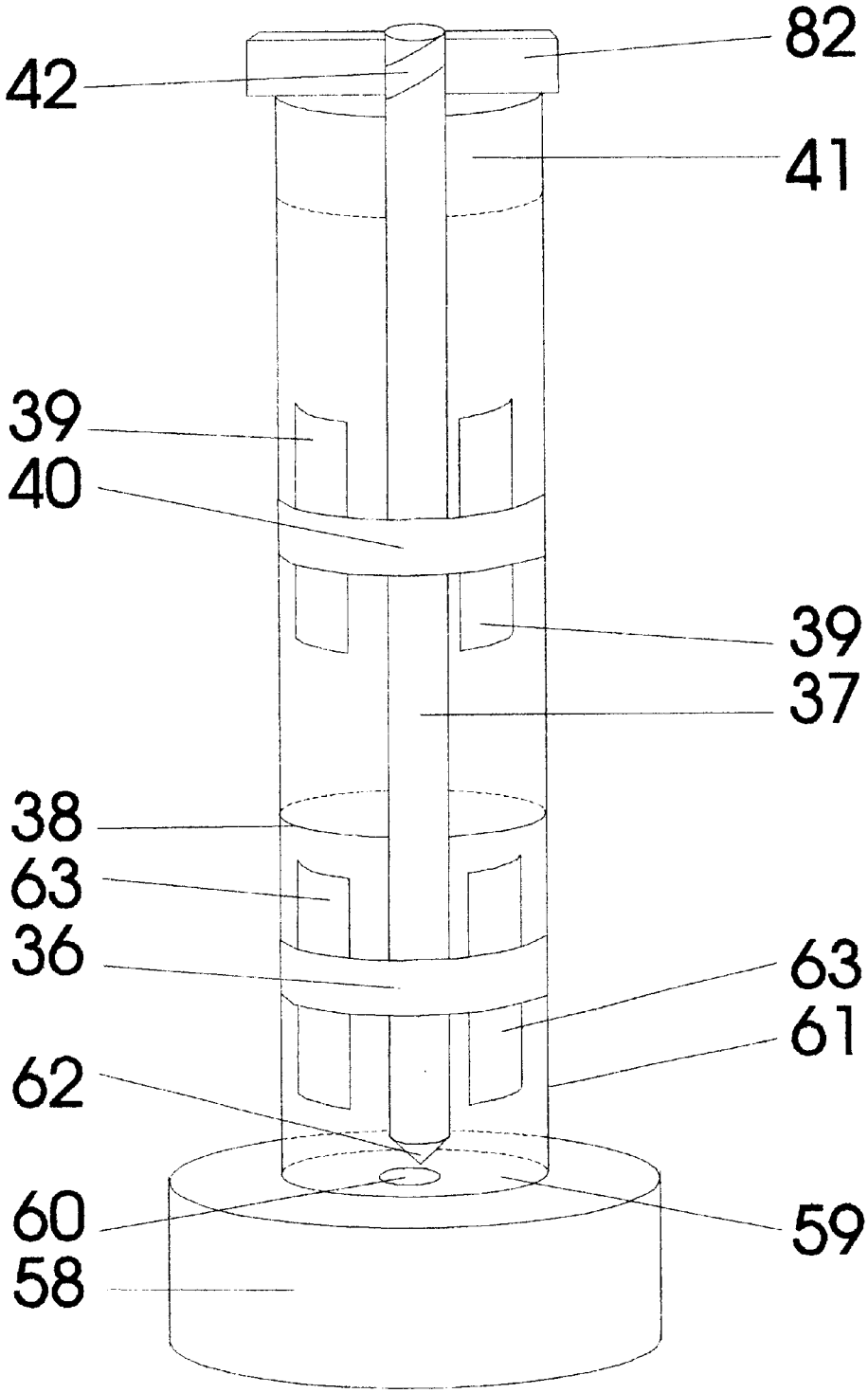
FIG. 1 shows an embodiment of the invention before use including a recess which will be used to support a skewer and filling during cooking.

A list of reference numbers follows on the next page.

REFERENCE NUMERALS IN DRAWINGS

36 felt strap
37 skewer
38 fill line
39 felt pad
40 Velcro strap
41 cap
42 male thread
43 pointed portion
44 cavity
45 vent
46 abscess
47 connection
48 female thread
49 removable section
50 store bought candy stick
51 male part
55 cooked batter
56 insert
57A fossa
57B fossa
57C fossa
58 base
59 disc
60 recess
61 molding tube
62 pointed tip
63 Velcro pad
64 molding tube bottom
65 base bottom
66 post
67 strawberry piece
68 sausage piece
69 black berry piece
70 female portion
71 male portion
72 rod
73 peg
74 hot dog
75 removable point
76 male threaded end
77 female threaded end
78 void
79 pointed end
80 insert handle
81 small cap handle
82 large cap handle

SUMMARY OF THE INVENTION

In accordance with the present invention a mold and a support which positions a stick within the mold, so that an added batter is able to form around the stick and any solid filling or fillings the stick may have skewered.

DETAILED DESCRIPTION OF THE PREFERRED EMBODIMENTS

Preferably, but not necessary, parts 43, 66, 75, 72, and 79 are not microwaveable. All other parts of the invention are preferably microwaveable safe. Preferably, all parts that are in contact with the food should be made of nonstick material. The exception to the last statement being those parts used to construct the skewer or piercing device.

FIG. 1 is an embodiment of the present invention. It includes a base 58 in contact with a molding tube 61. Molding tube 61 is in a vertical position. Molding tube 61 has one open end. A cap 41 has been inserted into the open end of molding tube 61. Cap 41 has a large handle 82. A disc 59 with a recess 60 rests on the bottom of molding tube 61. On the outside of molding tube 61 is a pair of felt pads 39. The two felt pads 39 are located horizontally across from eachother. A Velcro strap 40 bridges the distance between the two felt pads 39. Velcro strap 40 straps skewer 37 in a vertical position against molding tube 61. Skewer 37 is also strapped to molding tube 61 by a felt strap 36. Felt strap 36 bridges the distance between a pair of Velcro pads 63 located horizontally across from eachother. There is a fill line 38 formed on the outside of molding tube 61. The skewer 37 has a pointed tip 62 on one end and on the opposite end a male thread 42.

Figure 2:
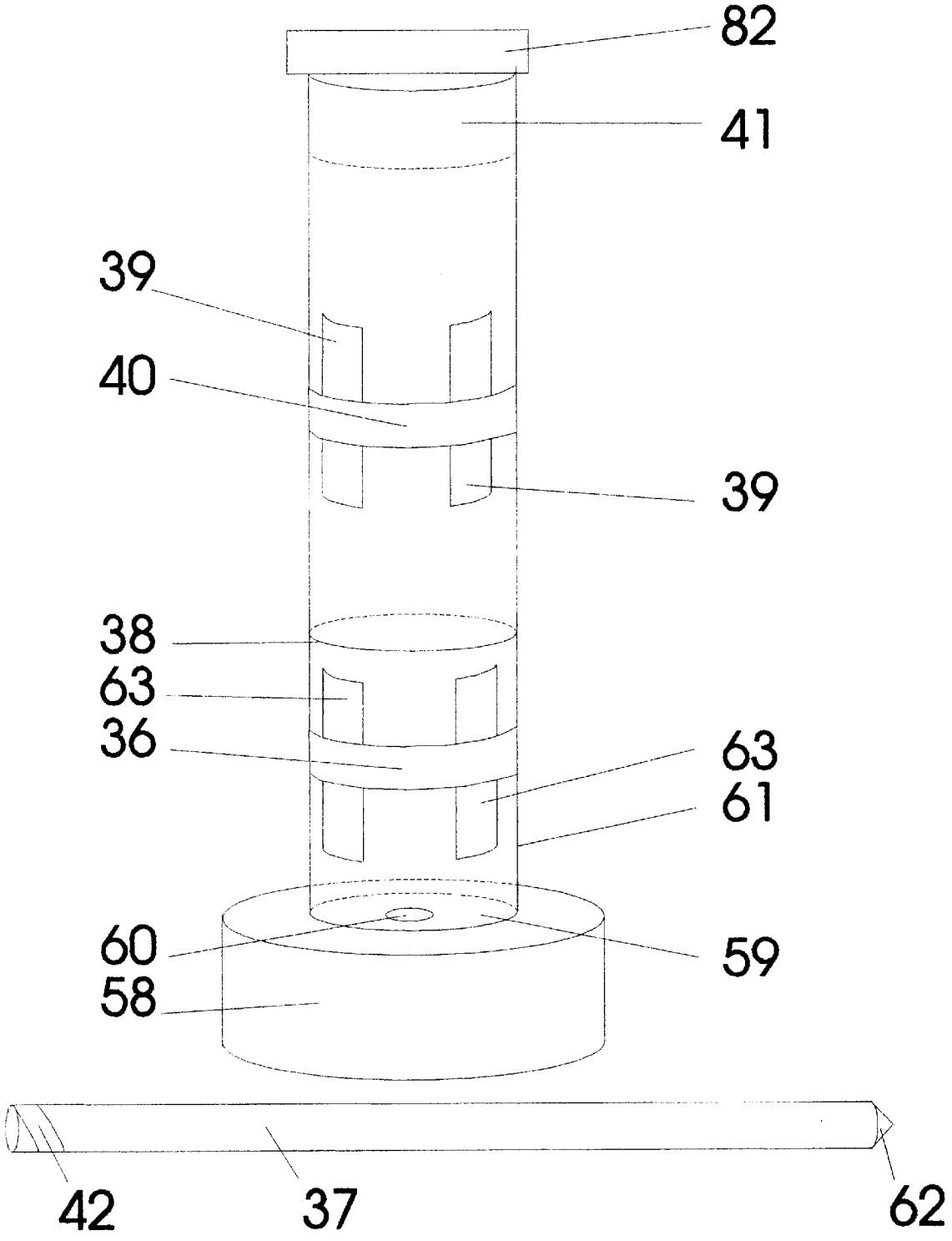
FIG. 2 shows the invention in FIG. 1 with a skewer removed from holding straps.

FIG. 2 shows the embodiment of the present invention in FIG. 1 with an unmoved cap 41 and cap handle 82. A skewer 37 is no longer strapped to a molding tube 61. A Velcro strap 40 was removed from a pair of felt pads 39. A felt strap 36 was also removed from a pair of Velcro pads 63, so that skewer 37 would no longer be strapped to molding tube 61. Velcro strap 40 and felt strap 36 have been put back to their original positions.

Figure 3:
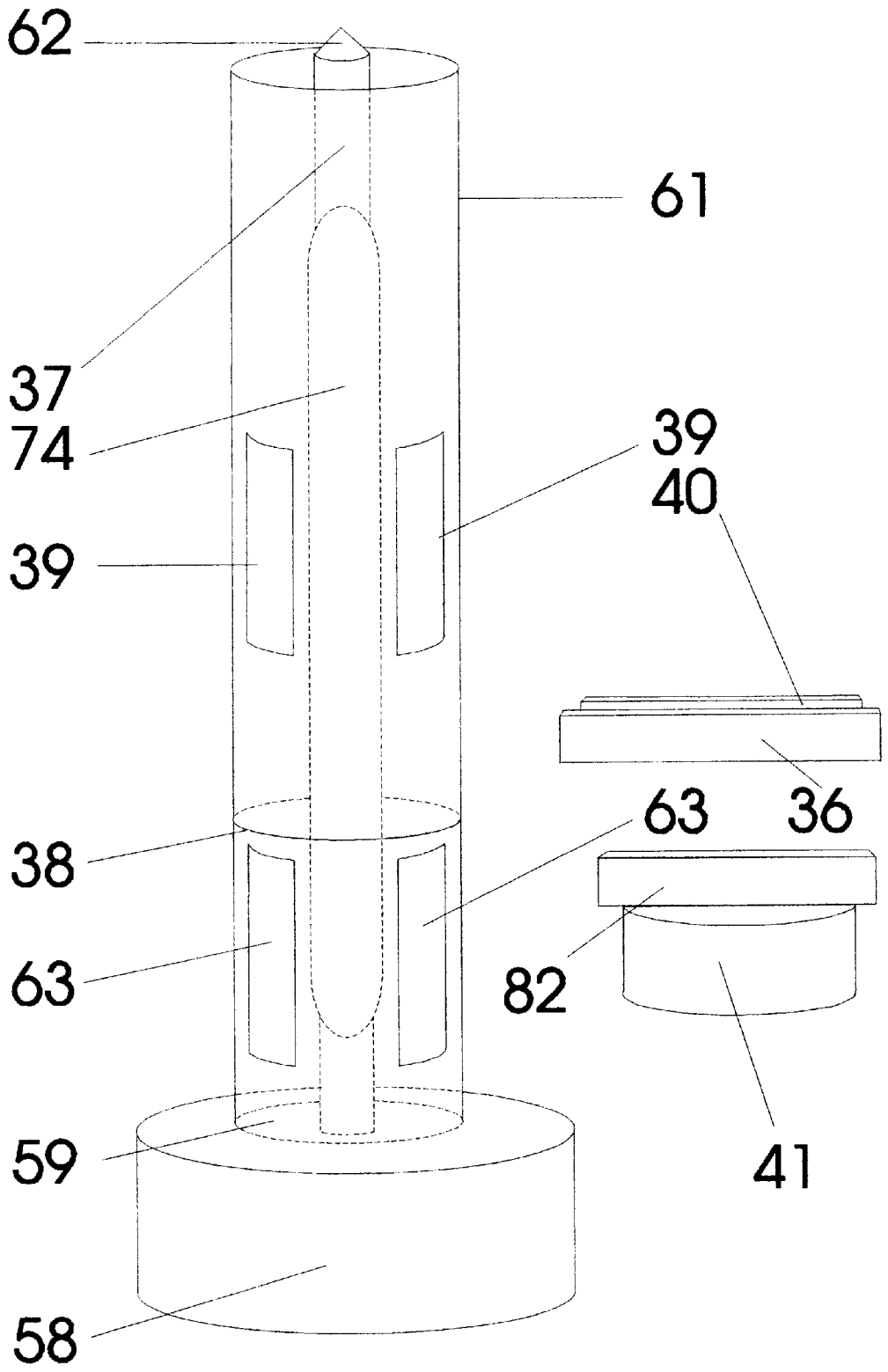
FIG. 3 shows the invention in FIG. 1 with a skewer having pierced a hot-dog which will be used as filling and that the skewer is supported by a recess in a base.

FIG. 3 shows the embodiment of the present invention in FIG. 1. A pointed tip 62 of skewer 37 has pierced a hot-dog 74. Using a large handle 82 a cap 41 has been removed to allow a male thread 42 of a skewer 37 to be inserted into a recess 60 of disc 59. A Velcro strap 40 and a felt strap 36 have been taken off of a pair of felt pads 39 and Velcro pads 63 respectively.

Figure 4:
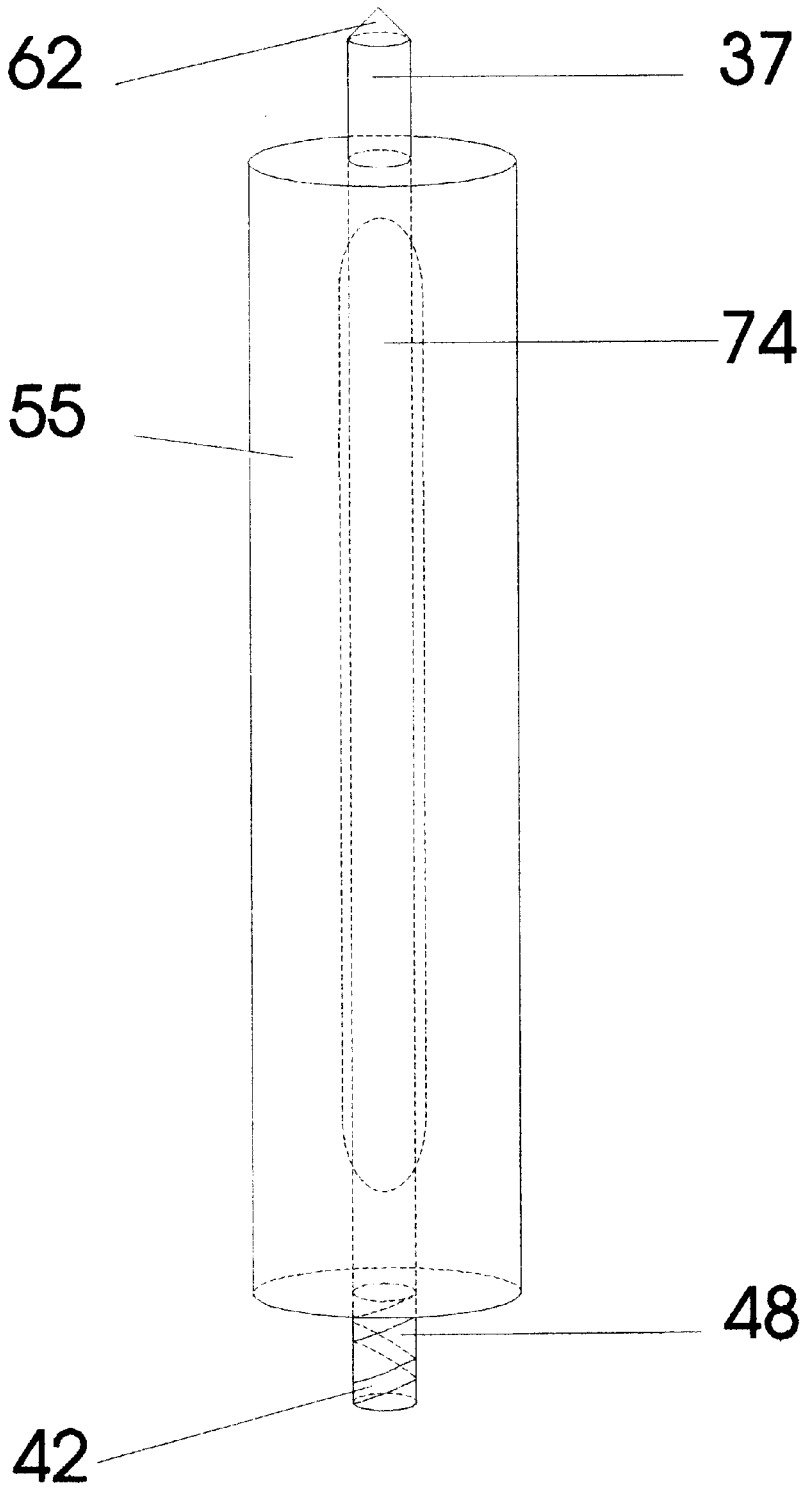
FIG. 4 shows an isometric view of a cooked food item after using an invention described in FIG. 1.

FIG. 4 shows an isometric view of a finished food item after it has been removed from a molding tube 61 and a disc 59.

Figure 5:
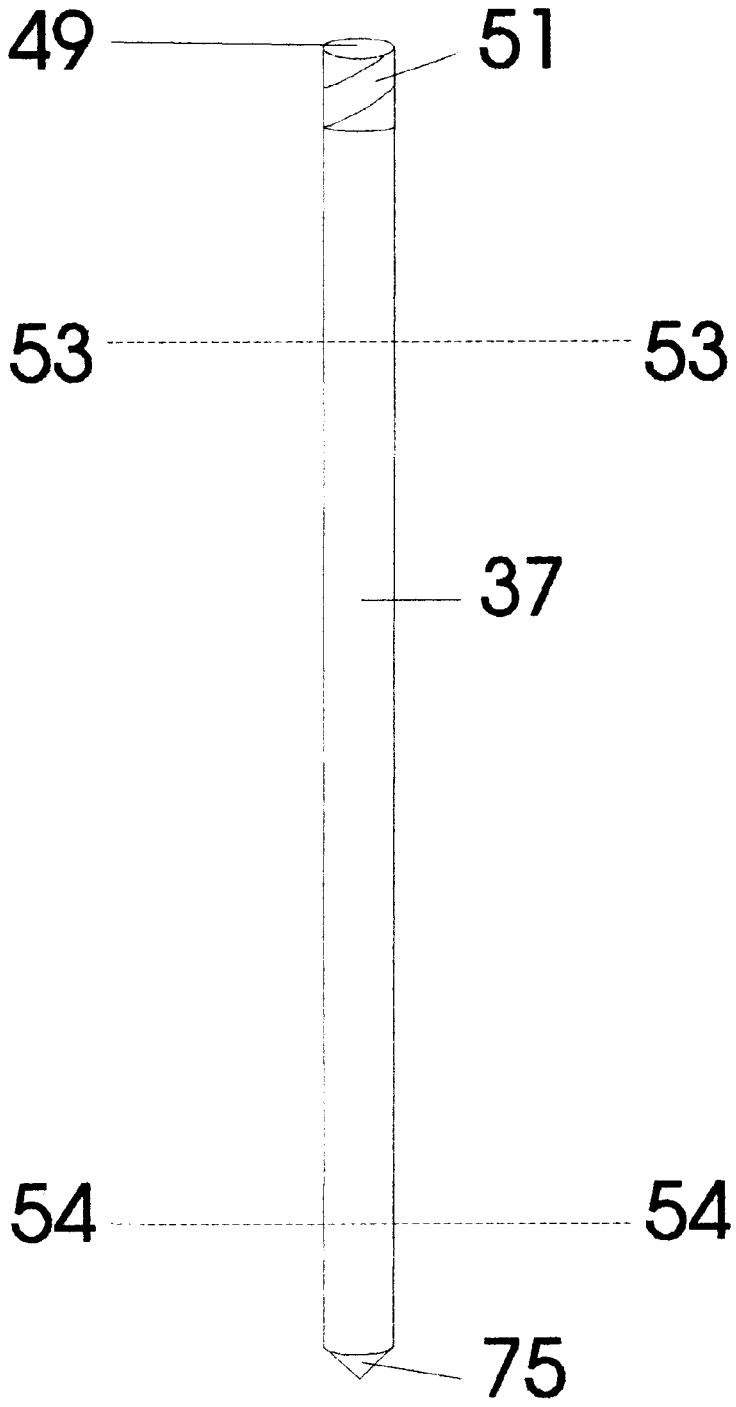
FIG. 5 shows an embodiment of a skewer whose ends are detachable.

FIG. 5 shows a skewer 37 modified with a removable section 49 at one end. Removable section 49 has a male part 51. At the opposite end of skewer 37 is a removable point 75.

Figure 6:
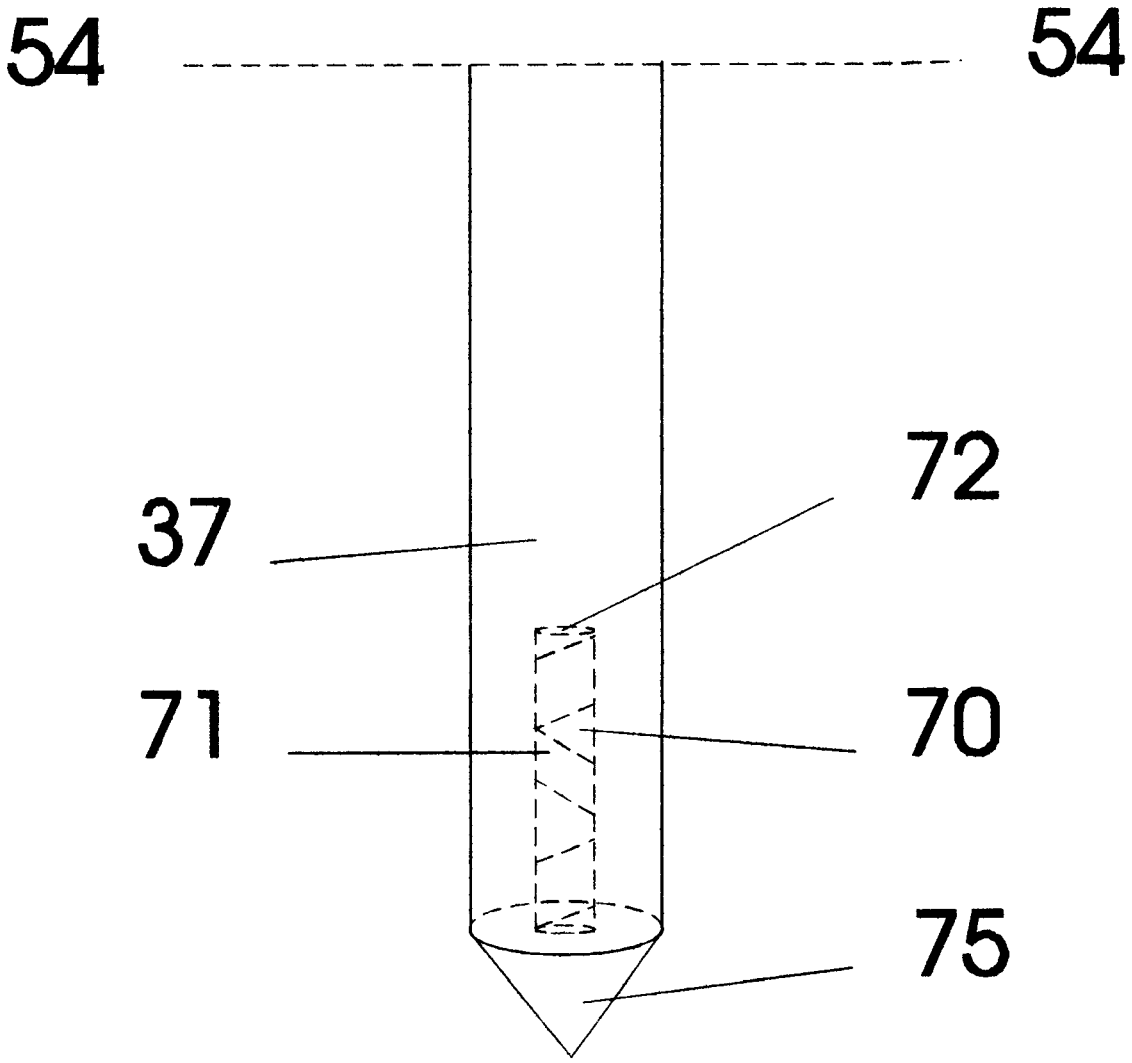
FIG. 6 shows an enlarged horizontal isometric view taken at 54—54 of FIG. 5.

FIG. 6 shows an enlarged horizontal isometric view taken at 54—54 of FIG. 5. A removable point 75 is connected to a rod 72. Rod 72 has a male portion 71 on it. Inside skewer 37 is a female portion 70. Male portion 71 makes contact with female portion 70. Removable point 75 and rod 72 are detachable from skewer 37, so removable point 75 and rod 72 do not necessarily need to be made of microwaveable materials.

Figure 7:
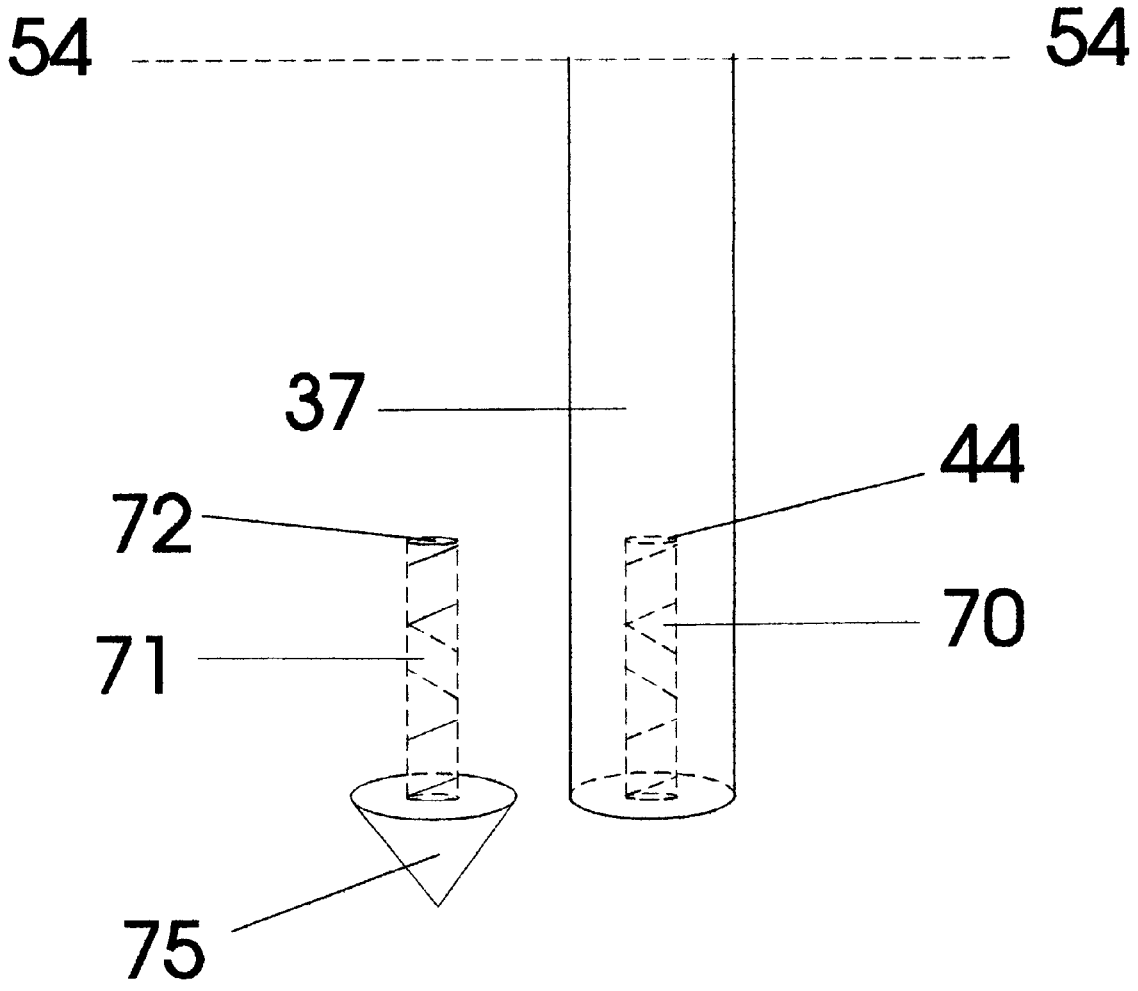
FIG. 7 shows an isometric view of a pointed tip in FIG. 6 removed from the body of the skewer from FIG. 6.

FIG. 7 shows an isometric view of the parts described in FIG. 6 in an alternate arrangement. A removable point 75 is connected to a rod 72 which includes a male portion 71. Removable point 75, rod 72, and a male portion 71 are no longer in contact with a female portion 70 of a skewer 37. The lack of contact between the parts previously mentioned in FIG. 7 has created a cavity 44 in skewer 37.

Figure 8:
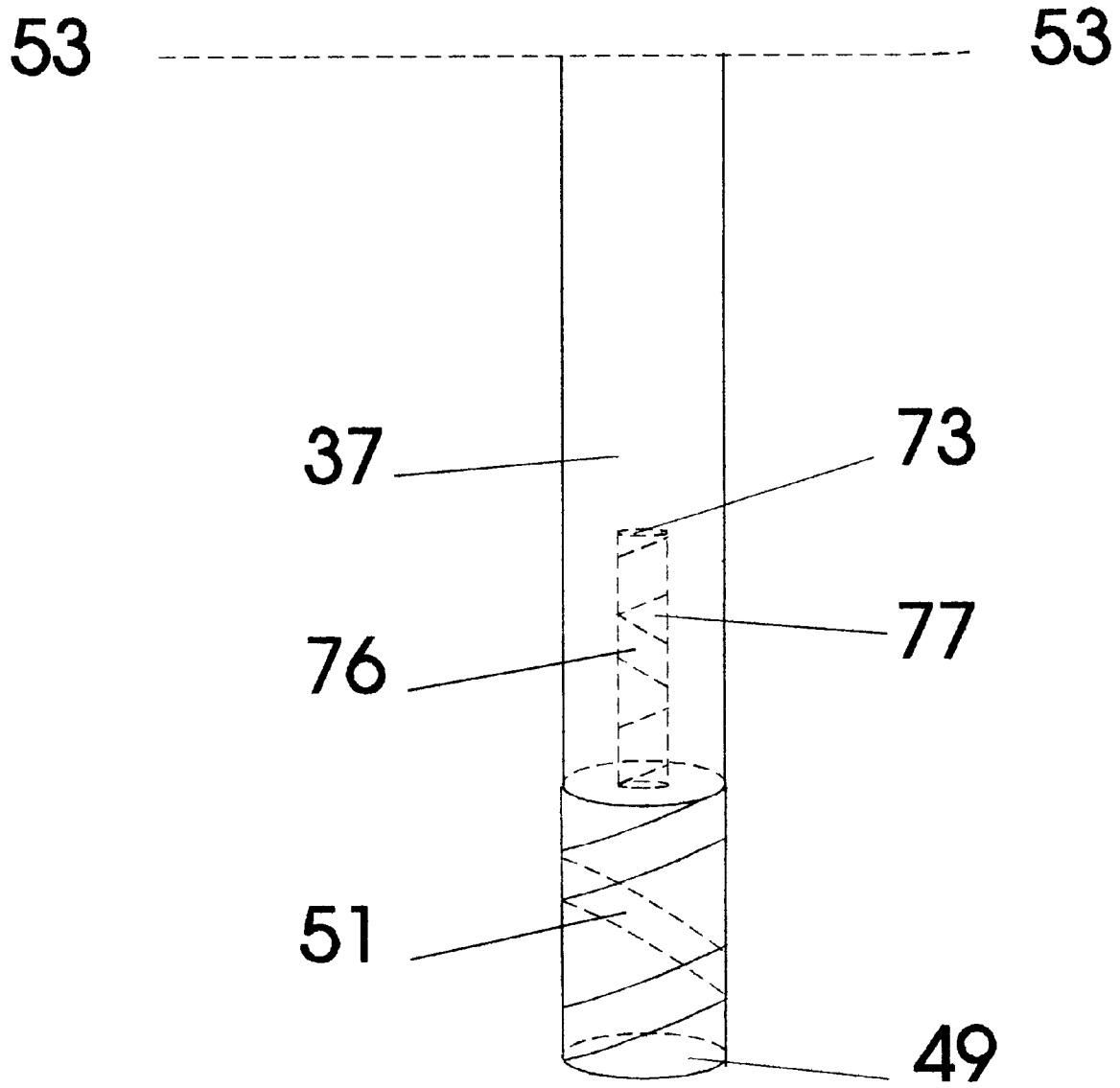
FIG. 8 shows an enlarged horizontal isometric view taken at 53—53 of FIG. 5.

FIG. 8 shows an enlarged horizontal isometric view taken at 53—53 of FIG. 5. It includes a male section 51 on the outside of a removable section 49. Removable section 49 is connected to a peg 73. Peg 73 has a male threaded end 76 on it. Inside a skewer 37 is a female threaded end 77. Male threaded end 76 is in contact with a female threaded end 77.

Figure 9:
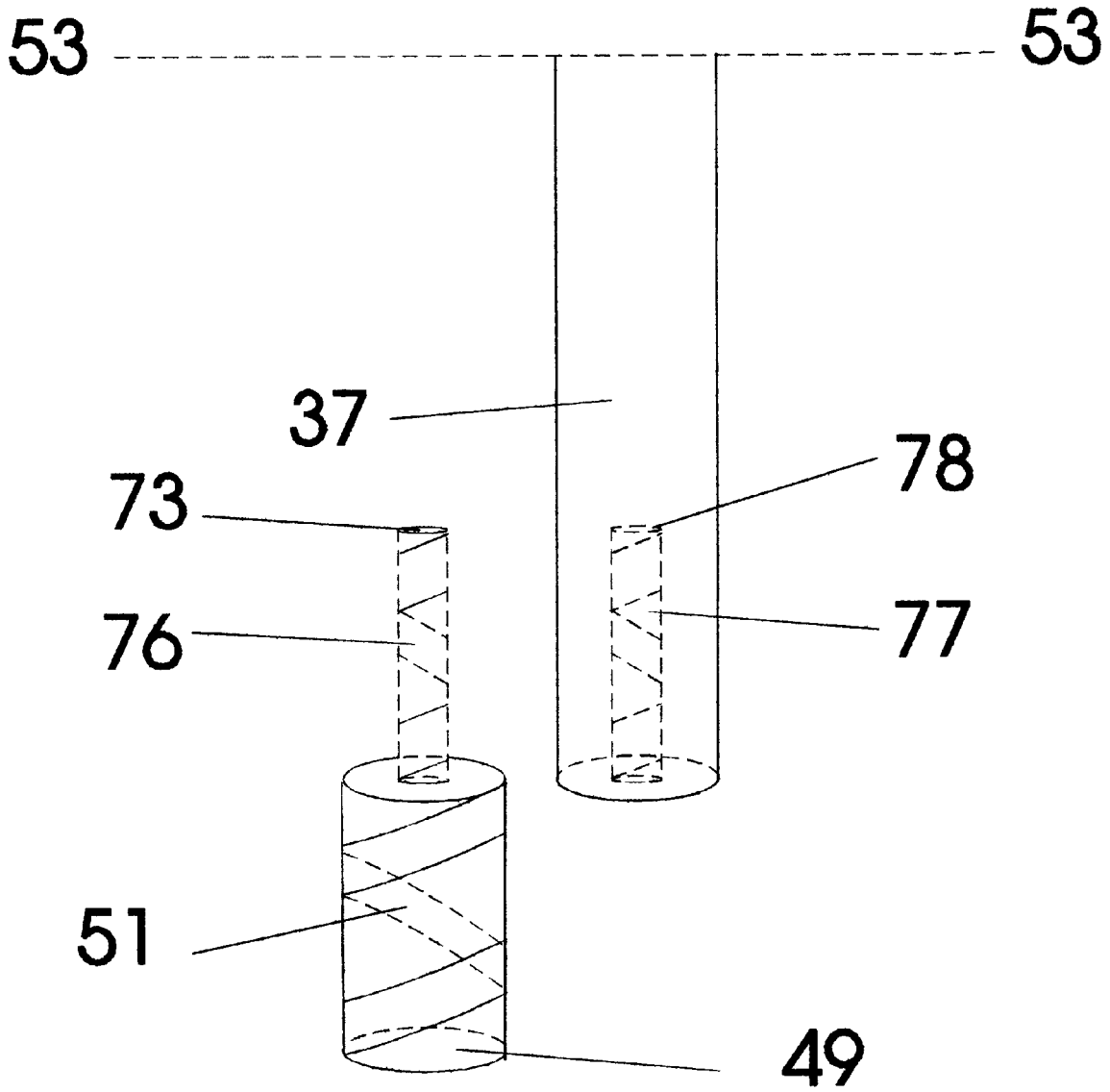
FIG. 9 shows an isometric view of the threaded tip in FIG. 8 removed from the body of the skewer from FIG. 8.

FIG. 9 shows an isometric view of the parts described in FIG. 8 arranged in an alternate position. A removable section 49 is connected to a peg 73. Peg 73 has a male threaded end 76 on it. Male threaded end 76 is no longer in contact with a female threaded end 77 of a skewer 37 The lack of contact as previously described in the discussion of FIG. 9 has created a void 78 located within the skewer 37.

Figure 10:
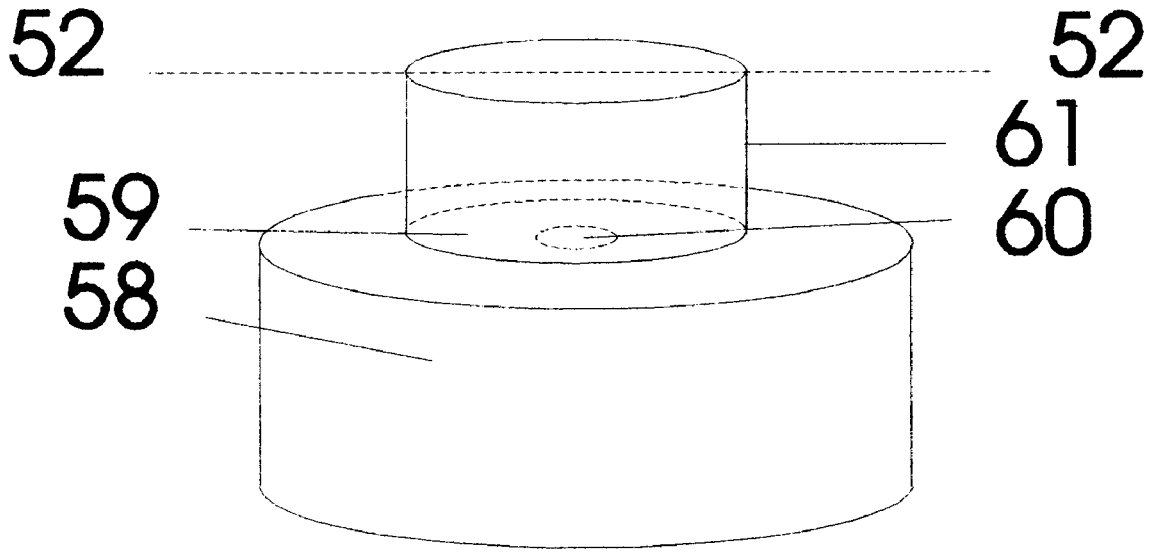
FIG. 10 shows a base, a short molding tube, a disc, and a recess arranged like similar parts used in FIG. 1.

FIG. 10 shows a base 58. Base 58 is in contact with a short molding tube 61. A disc 59 is within molding tube 61. The position of disc 59 is at the lowermost end of molding tube 61. There is a recess 60 in disc 59.

Figure 11:
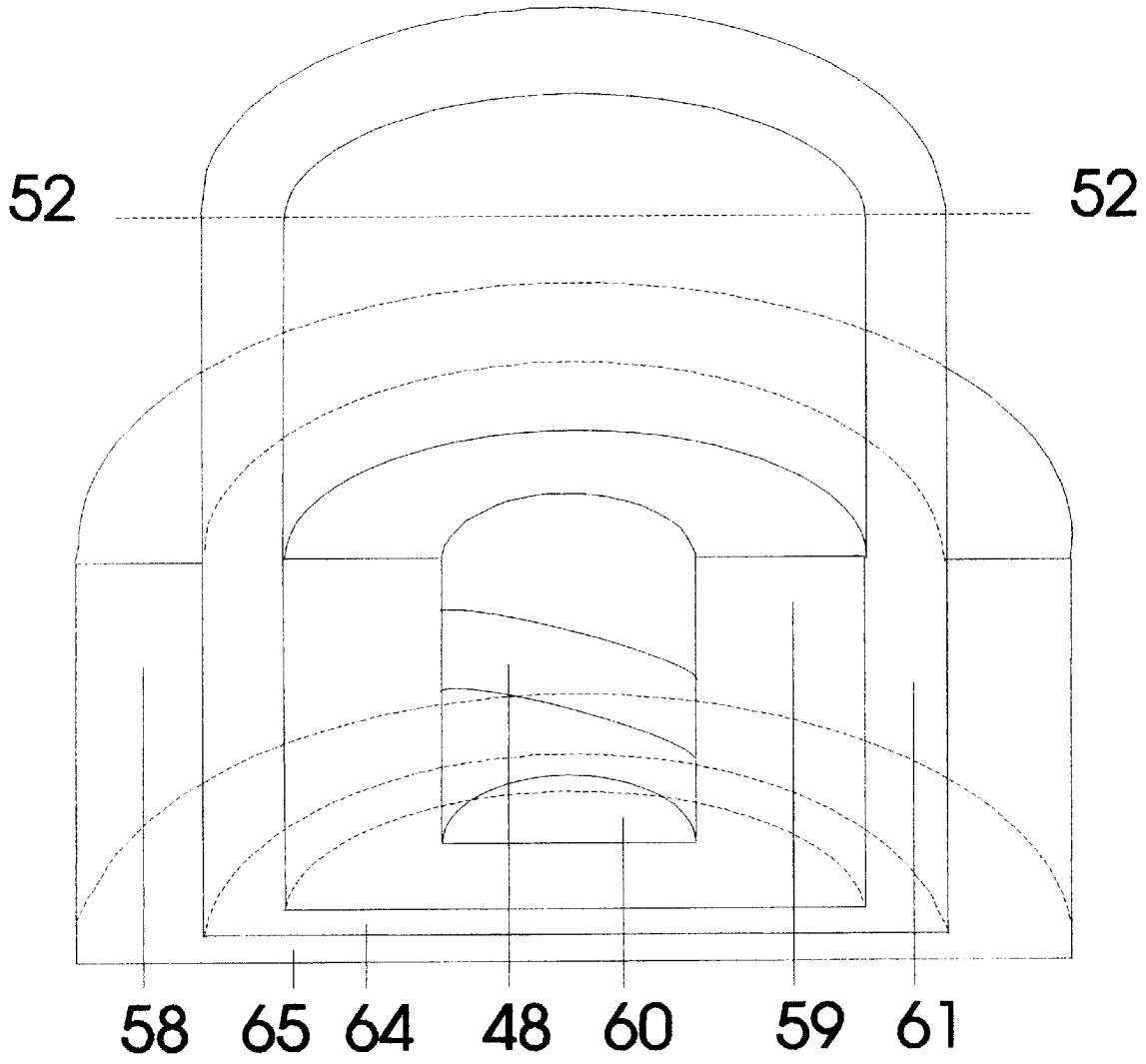
FIG. 11 is an enlarged vertical isometric view of FIG. 10 taken at 52—52 showing a recess in a disc resting in the bottom of a molding tube which is lying within a base.

FIG 11 is an enlarged vertical isometric view of FIG. 10 taken at 52—52. There is a molding tube 61, a base 58, and a base bottom 65. Also shown is a molding tube bottom 64 resting on the base bottom 65. A disc 59 rests on the molding tube bottom 64. There is a recess 60 in disc 59. The recess 60 in disc 59 has a female thread 48.

Figure 12:
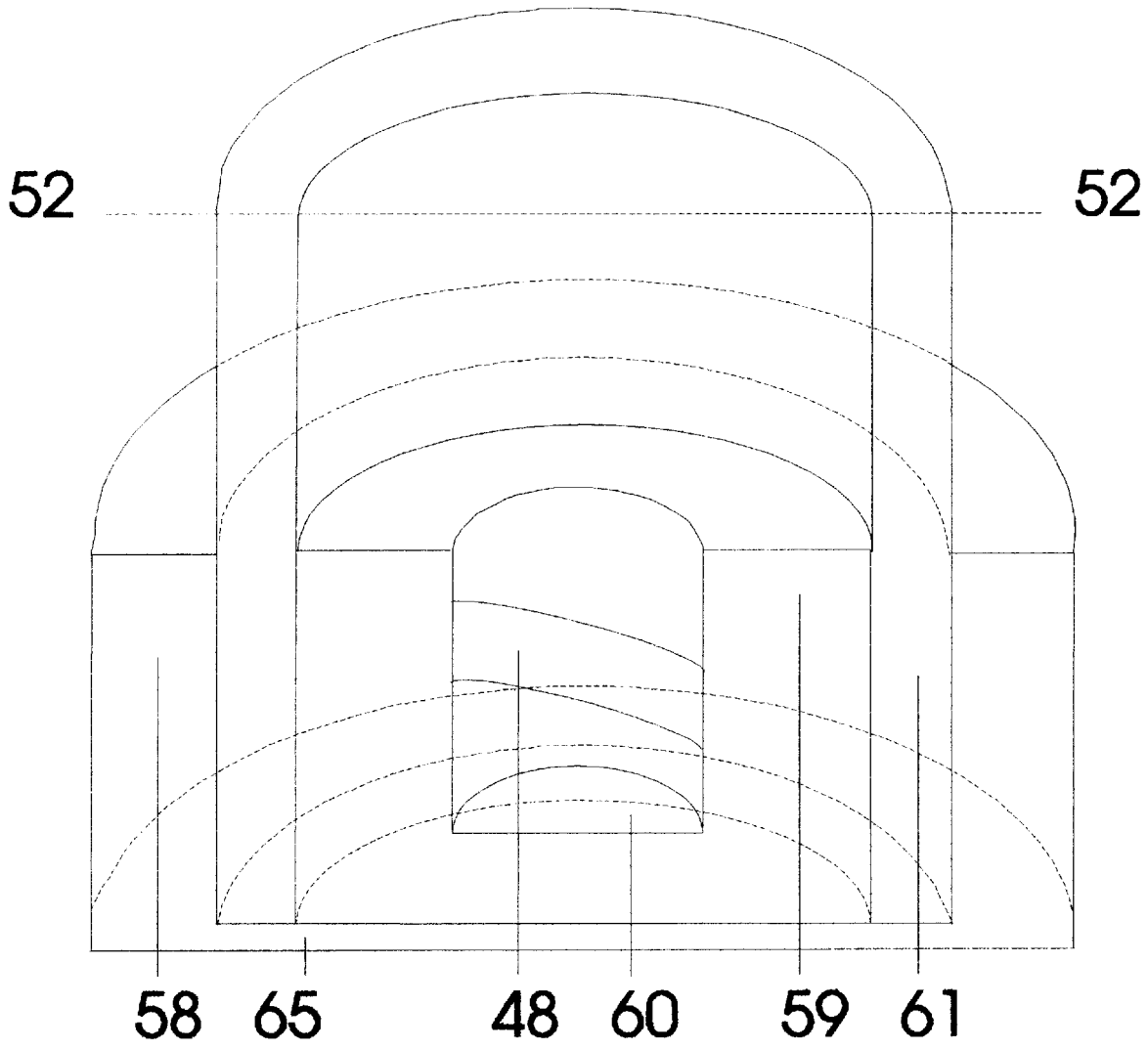
FIG. 12 is an enlarged vertical isometric view of a modified FIG. 10, showing a double open ended molding tube and a disc resting on the bottom of a base.

FIG. 12 is an isometric view of a modification of FIG 11. It shows a molding tube 61, a base 58, and a base bottom 65. A molding tube bottom 64 has been omitted so that molding tube 61 is open at both ends. The lowermost open end of molding tube 61 rests on the base bottom 65. A disc 59 rests on the base bottom 65 while the sides of disc 59 are surrounded by molding tube 61. The recess 60 in disc 59 has a female thread 48.

Figure 13:
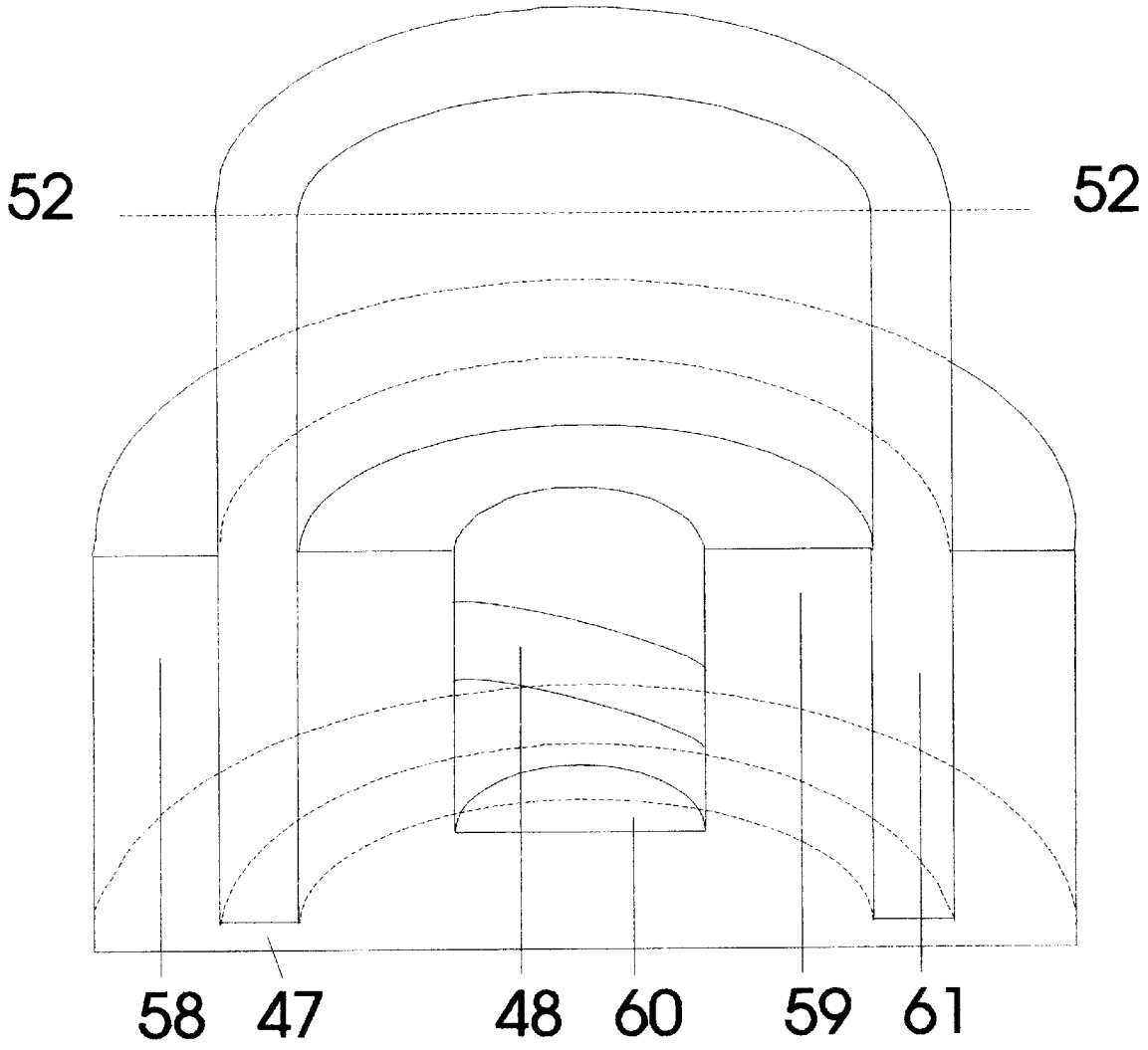
FIG. 13 is an enlarged vertical isometric view of a modified FIG. 10, showing a double open ended molding tube resting on a connection between a base and a disc with a recess.

FIG. 13 is an isometric view of a modification of FIG. 11. It shows a molding tube 61, a base 58, and a disc 59. A connection 47 joins the disc 59 and base 58. The lowermost open end of molding tube 61 rests on connection 47. A recess 60 in disc 59 has a female thread 48.

Figure 14:
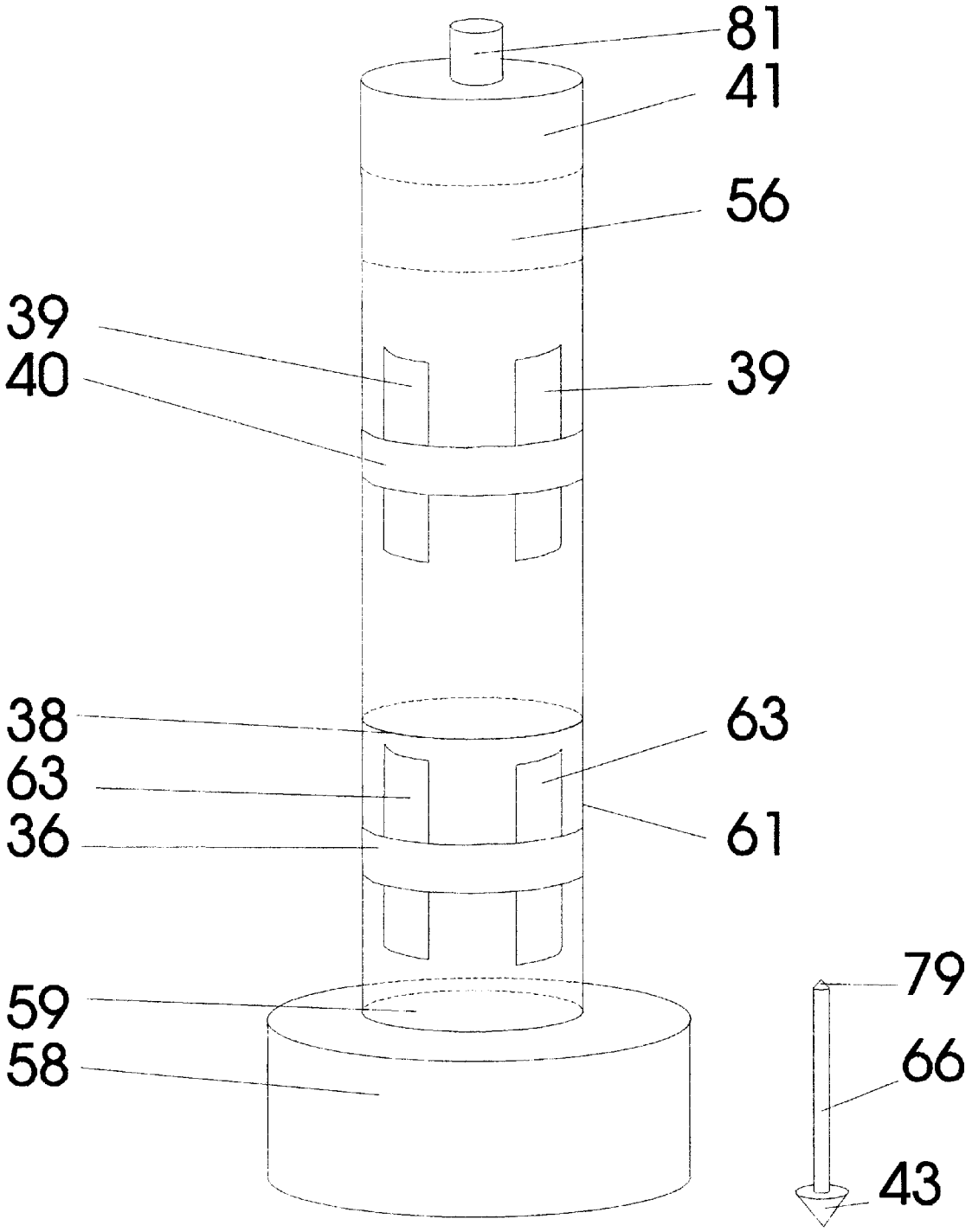
FIG. 14 is the preferred embodiment of the present invention.

FIG. 14 is the preferred embodiment of the present invention. It includes a base 58 in contact with a molding tube 61. Molding tube 61 is in a vertical position and has a double open end. A cap 41 is present in molding tube 61. Cap 41 has a small handle 81. Below cap 41 is an insert 56. On the outside of molding tube 61 is a pair felt pads 39 horizontally spaced across from eachother. A Velcro strap 40 bridges the distance between the two felt pads 39. A felt strap 36 bridges the distance between a pair of Velcro pads 63 spaced horizontally across. A store bought candy stick 50, not shown, could be stored on molding tube 61 like skewer 37 by using Velcro strap 40 and felt strap 36. A fill line 38 has been formed on the outside of molding tube 61. A pointed portion 43 is connected to a post 66. Post 66 has a pointed end 79 to aid in piercing store bought candy stick 50

Figure 15:
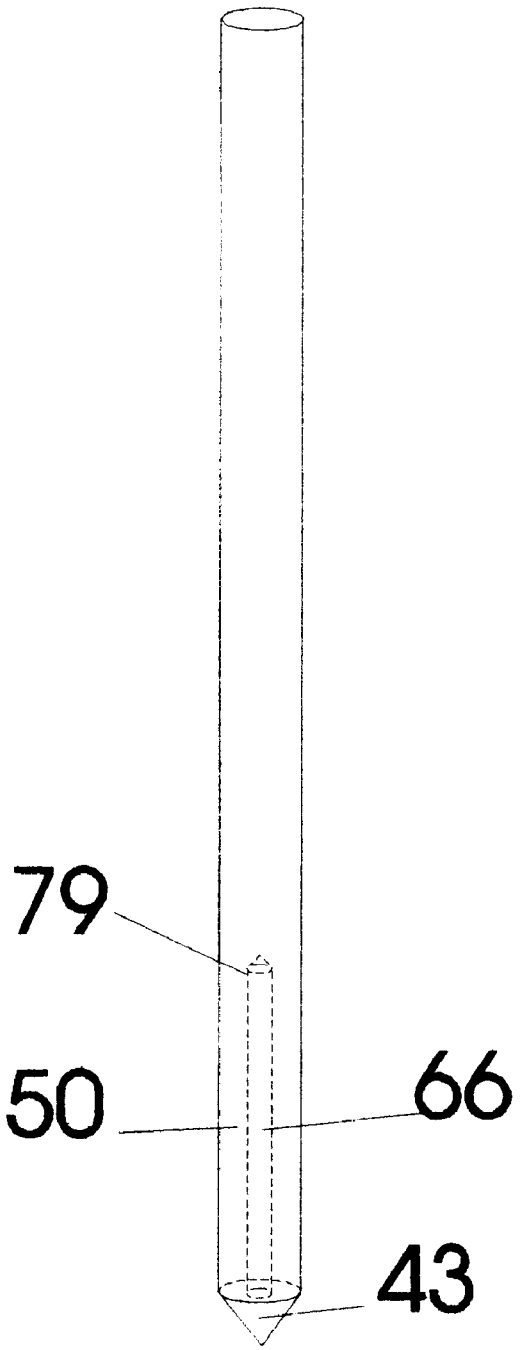
FIG. 15 shows how a skewer tip in FIG. 14 is connected to a store bought candy stick to make a skewer suitable for use in the present invention.

FIG. 15 shows an isometric view of a pointed portion 43 connected to a post 66. Post 66 is connected to pointed end 79. Pointed end 79 has pierced through an end of a store bought candy stick 50 and been wedged into store bought candy stick 50. With pointed end 79 stationary. pointed portion 43 is able to act like pointed tip 62 of skewer 37. Pointed portion 43, pointed end 79, and post 66 are detachable from store bought candy stick 50, so they could be made of non-microwaveable material and removed from store bought candy stick 50 prior to cooking.

Figure 16:
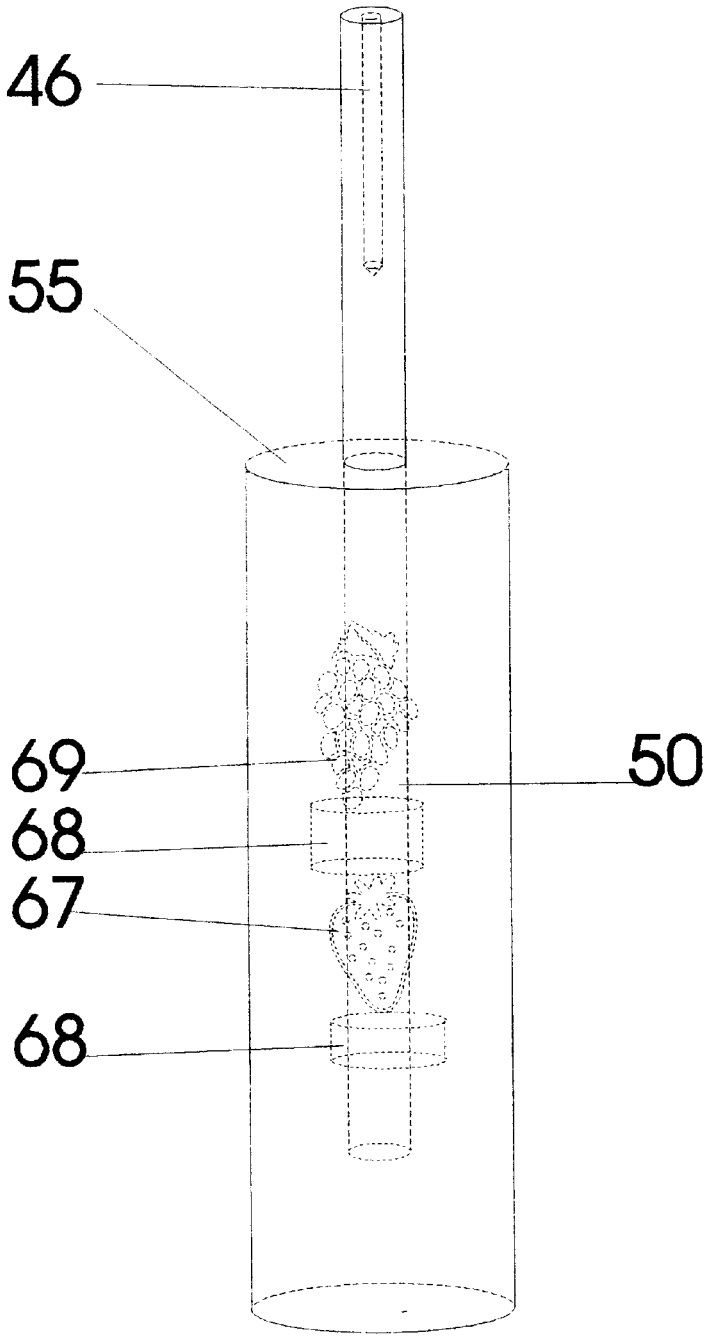
FIG. 16 shows an isometric view of a food item prepared using an embodiment of the present invention as described in FIG. 14 and FIG. 15.

FIG. 16 shows isometric view of a finished food item after it has been removed from a molding tube 61 and an insert 56. Prior to cooking pointed portion 43 was removed from store bought candy stick 50. The exclusion of pointed portion 43 has created an abscess 46. The abscess 46 has been positioned at the uppermost end of the food product, so that a cooked batter 55 will not have a chance to form in abscess 46.

Figure 17:
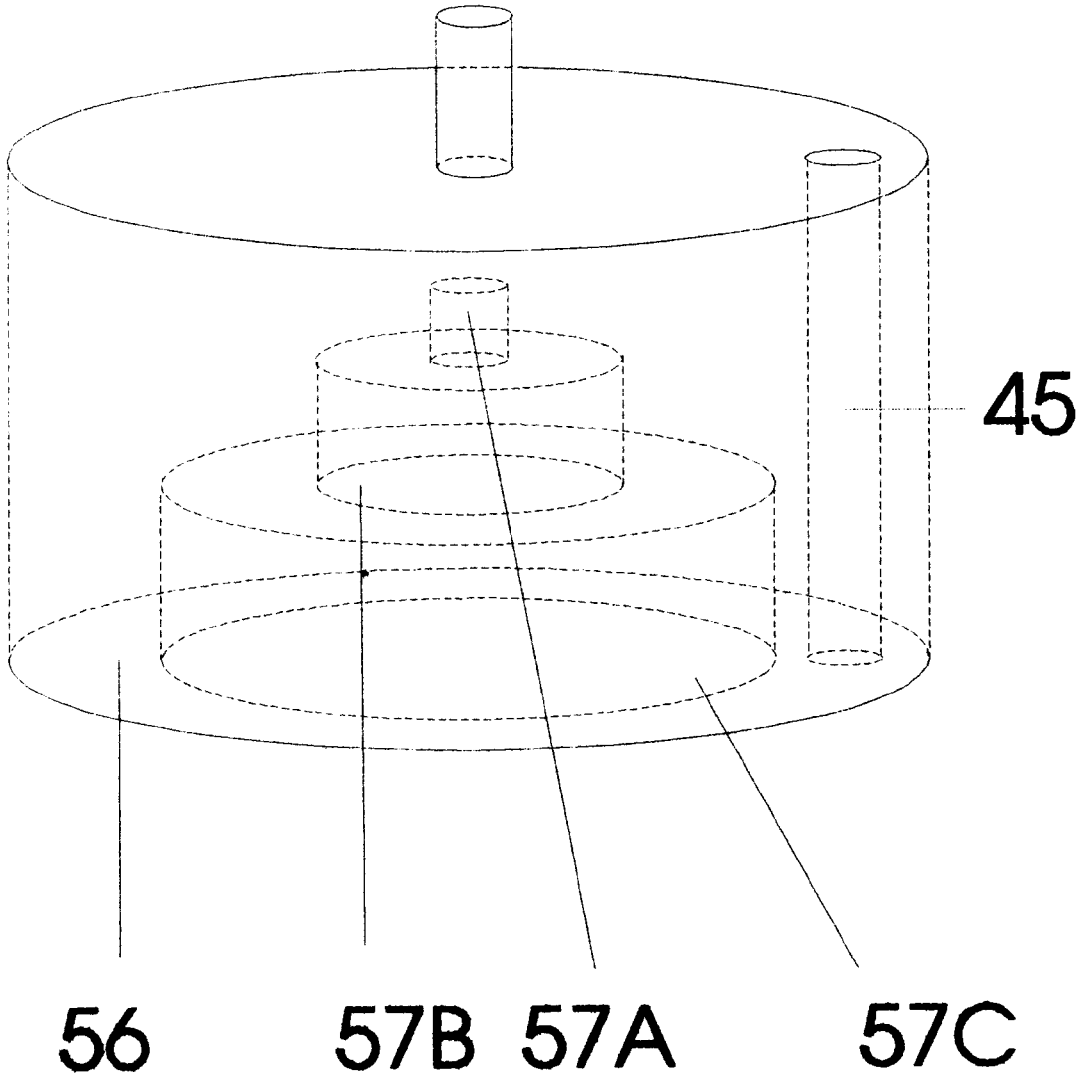
FIG. 17 shows an isometric view of an insert consisting of a handle and a nest of recesses intended to rest in an opening at the uppermost end of a molding tube.

FIG. 17 is an isometric view of an insert 56. An insert handle 80 is on top of insert 56. The insert 56 has a stopper shape and includes a nest of a fossa 57A, a fossa 57B, and a fossa 57C. A vent 45 spanning the distance from top to bottom of insert 56 is also present. To be as effective as possible insert 56 should be made of a material capable of conforming to a variety of skewer shapes.

Figure 18:
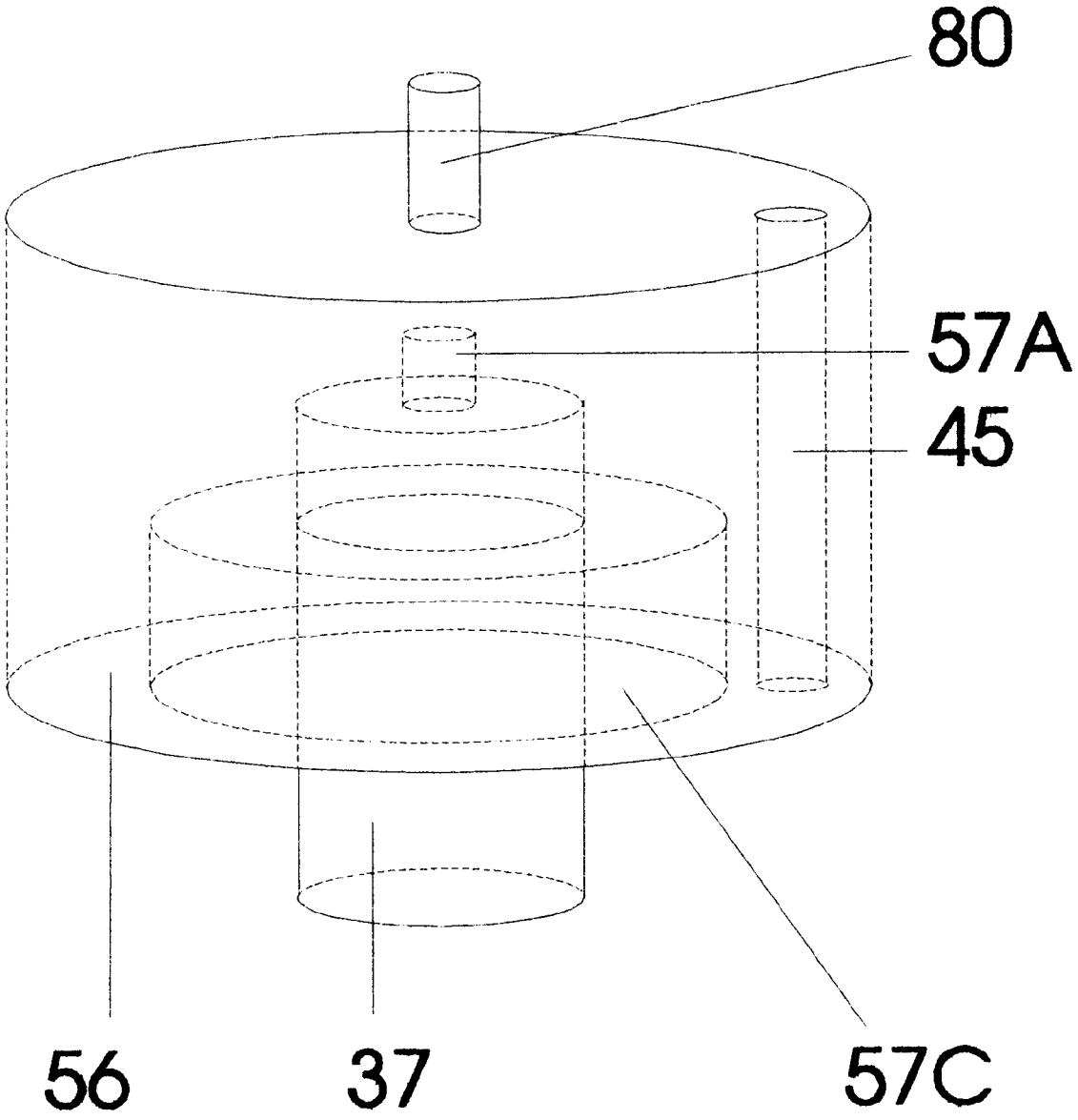
FIG. 18 shows an isometric view of a short skewer supported by an insert described in FIG. 17.

FIG. 18 is an isometric view of an insert 56. On top of insert 56 is an insert handle 80. A vent 45 is also present. A skewer 37 has been inserted into fossa 57B. A fossa 57A and a fossa 57C are empty.

Figure 19:
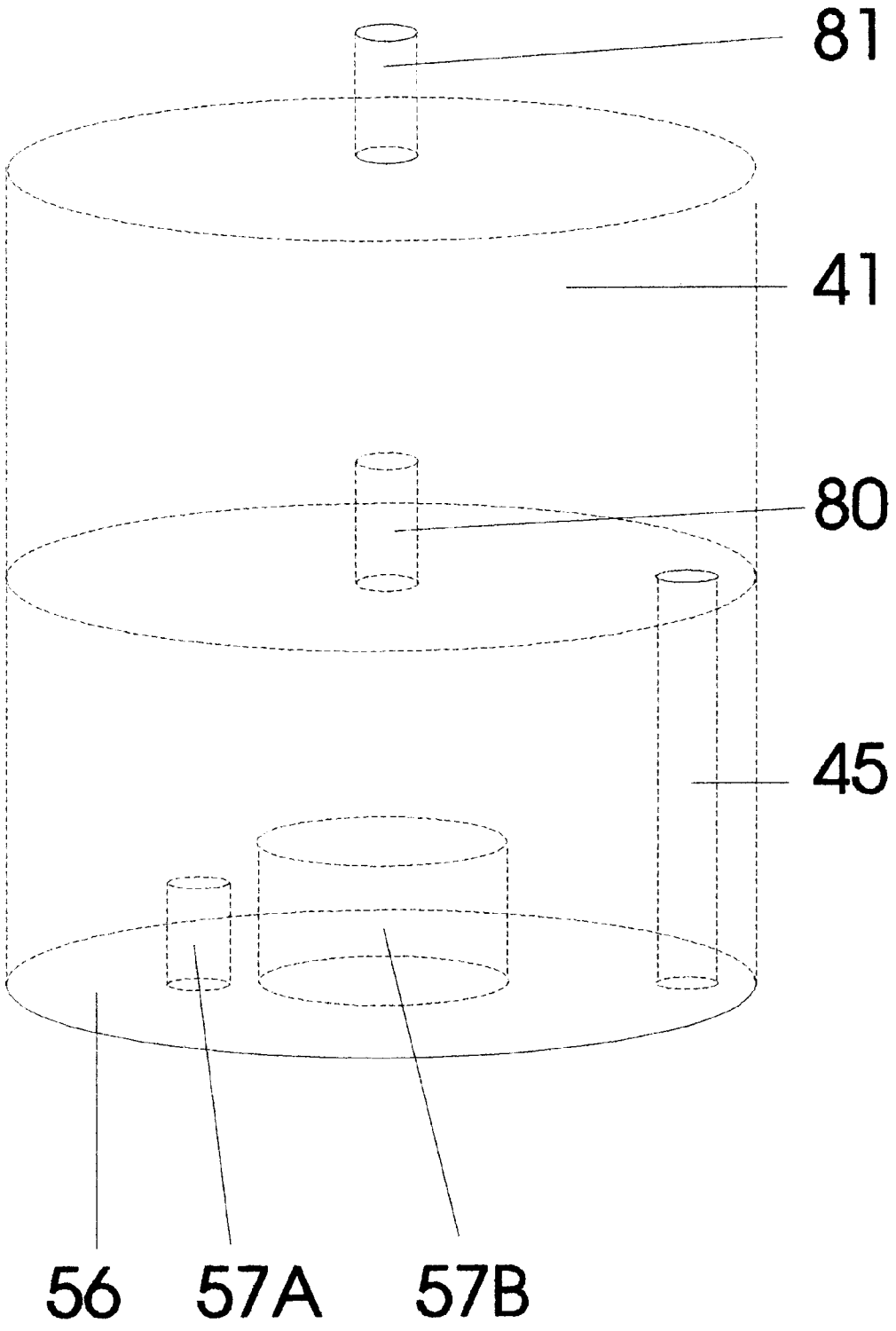
FIG. 19 is a modification of FIG. 17 where the inset is in contact with a cap, and a plurality of insert recesses are not nested but rather spread out over the surface area.

FIG. 19 is an isometric view of an insert 56 in contact with a cap 41. Insert handle rest within the underside of cap 41. The insert 56 includes a fossa 57A and a fossa 57B with a different radius than fossa 57A. A vent 45 is also present.

Operation

The manner of using the cooking appliance for cooking a batter wrapped filling product on a stick is as follows. Batter is mixed in a separate bowl. The molding tube 61 and base 58 are then connected if not already done. This will provide a watertight container to place batter in and allow molding tube 61 to maintain and upright position.

Molding tube 61 and base 58 can be connected in one of the following ways as illustrated in FIG. 11, FIG. 12, and FIG. 13.

In FIG. 11, a molding tube 61 has a closed end, a molding tube bottom 64. Molding tube bottom 64 is inserted into a base 58 so that the molding tube bottom 64 comes to rest on a base bottom 65. A disc 59, with a recess 60, is then inserted into the open end of molding tube 61 so that disc 59 comes to rest on the molding tube bottom 64. This type of arrangement is present in FIG. 1. By omitting recess 60, this arrangement can also be used in FIG. 14.

In FIG. 12, the molding tube 61 is double open ended. The end closest to a fill line 38 is inserted into base 58 so that the molding tube comes to rest on base bottom 65. A disc 59, with a recess 60, is then inserted into the exposed open end of molding tube 61 so that disc 59 comes to rest on base bottom 65. This arrangement can also be used in FIG. 1. The described arrangement of FIG. 12 can be used in FIG. 14 if disc 59 is turned over so that recess 60 is not exposed. This modification will prevent batter from entering recess 60.

In FIG. 13, the molding tube 61 is double open ended. A recess 60 is present in a disc 59. The end closest to a fill line 38 is inserted into base 58 so that the molding tube is in-between a disc 59 and base 58. Molding tube 61 comes to rest on a connection 47. This type of arrangement can be used in FIG. 1. By eliminating a recess 60 in disc 59 the arrangement can be used in FIG. 14.

The following is an explanation of how to use the invention of FIG. 1 once the molding tube 61 and base 58 have been configured to form a watertight container. Molding tube 61, disc 59, and recess 60 should be made of non-stick material. If they are not or have lost their non-stick ability a lubricant such as cooking spray or cooking oil can be used to prevent sticking of food product to previously mentioned parts.

Using a large handle 82, a cap 41 is removed if not already done in connecting molding tube 61 to base 58. Velcro strap 40 and felt strap 36 are removed from felt pad 39 and Velcro pad 63 respectively, This action allows skewer 37 to be separated from molding tube 61. If solid filling is intended, the desired solid filling is pierced with skewer 37 using pointed tip 62.

The skewer 37 and desired fillings are then placed in the molding tube 61. A male thread 42 on skewer 37 is inserted into recess 60 in disc 59 with a turning force. Skewer 37 is now in an upright position and no longer needs to be held by the consumer.

The prepared batter is poured to fill line 38. Depending on skewer 37 design being used, the consumer using the design described in FIG. 5 may wish to remove removable point 75. At this point the cap 41 can be replaced by using large handle 82. The assembly can be stored for future use.

Upon continuing, large handle 82 is used to remove cap 41. Velcro strap 40 and felt strap 36 are also removed and put off to the side. The assembly as described so far is put in the microwave in an upright position The microwave contents are heated. Meat ingredients embedded in the batter are cooked simultaneously as the batter is cooked. After cooking the contents are removed from the microwave. Holding onto the end of skewer 37 the food item is removed from the molding tube 61 by untwisting skewer 37 and lifting the food product. The consumer may wish to remove removable section 49 at this time if the skewer 37 as described in FIG. 5 is being used.

The following is an explanation of how to use the invention of FIG. 14 once the molding tube 61 and base 58 have been configured to form a watertight container. Molding tube 61, disc 59, and an insert 56 should be made of non-stick material. If they are not or have lost their non-stick ability a lubricant such as cooking spray or cooking oil can be used to prevent sticking of food product to previously mentioned parts.

To continue using the invention shown in FIG. 14, cap 41 should be removed using small handle 81 if it is still in place after connecting molding tube 61 and base 58. Insert 56 should be removed from molding tube 61 using insert handle 80 if it is still in place after connecting molding tube 61 and base 58.

A pointed portion 43 should then be connected to a store bought candy stick 50. This union is achieved by pushing post 66 into one end of the store bought candy stick 50. This action can be eased by a pointed end 79. The joining of post 66 and store bought candy stick 50 is not needed unless solid filling is desired. If solid filling is not desired, skewer 50 can inserted into a fossa 57 at this time.

If solid filling is desired, the solid fillings can be pierced using pointed portion 43 which is connected to a store bought candy stick 50. Once desired filings have been pierced, pointed portion 43 can be separated from skewer 50.

This is advantageous to consumers who do not wish the food product to have a pointed edge. These consumers might be parents of small children or care givers to people with mental difficulties. Manufacturers might also recommend removal of pointed portion 43 to eliminate the risk of swallowing pointed portion 43 while consuming food item.

To encourage the removal of pointed portion 43 a manufacturer may make pointed portion 43, pointed end 79, or post 66 of non-microwaveable material. A written warning in device directions presenting the advantages of removing pointed portion 43 might work. Microwave ovens are common today and most people know not to put metal into the microwave. A noticeable metallic part, either pointed portion 43, pointed end 79, or post 66, would be another deterrent to using pointed portion 43 in the microwave oven.

After deciding whether to remove pointed portion 43 from skewer 50, skewer 50 can be inserted into a fossa 57A, 57B, or 57C. If the pointed portion 43 is removed then the end containing abscess 46 should be inserted into the chosen fossa. This would prevent batter from entering abscess 46

Batter is then added to molding tube 61 up to fill line 38. Skewered food, skewer assembly, and insert 56 are then placed into molding tube 61, so that skewer assembly and skewered food are first to enter molding tube 61. Insert 56 is now resting in the uppermost portion of molding tube 61. Expanding gases within molding tube 61 exit during cooking via vent 45.

After heating, insert handle 80 is pulled out of molding tube 61. The result, is the removal of insert 56 and the cooked food product from molding tube 61. The insert 56 is then pulled off of the store bought candy stick 50. The consumer can now allow the food product to cool to the desired temperature before consuming food product.

Conclusion, Ramifications, and Scope

Thus the reader will see that the food mold of the invention provides a number of advantages over prior art in that

- it permits easy storage in a office desk or locker;
- it allows contents to be cooked evenly and simultaneously;
- it has the same availability as a microwave oven;
- the product formed can be eaten without a flat surface;
- the product formed can be eaten without soiling fingers or using fork or knife;
- skewer is kept in an upright position not by batter thickness but with help of skewer support;
- product preparation time does not include separate cleaning times of filling and batter cooking pans;
- batter manufacture directions may be followed to allow exact caloric content of batter to be known;
- product is not fried and so does not contain calories from frying oil;
- pointed end of skewer is capable of being detached from skewer, reducing the potential of skewer stabbing;
- flavors from embedded ingredients are organized by skewer which eliminates the need to cook multiple food items.

While my previous description contains many specifications these should not be construed as limitations on the scope of the invention, but rather as an exemplification of preferred embodiments thereof Many other variations are possible. For example the base, molding tube, and skewer can have other shapes, such as oval triangular, etc.; the base and molding tube can be attached with Velcro-felt closure; the cap can have a different shape; the insert can have a different shape which might engage both inside and outside of molding tube, different number of fossa, or different number of vents; a recess 60 or fossa 57 could have a pointed shape or vary in amount of threading; the parts that fill these structures would then need to be changed accordingly; removable point 75, rod 72, pointed portion 43, post 66, and pointed end 79 can be made of a non-microwaveable material. Thus the scope of the invention should be determined by the appended claims and their legal equivalents, rather than by the examples given.

I claim:

1. A microwable cooking device for microwave oven use simultaneously cooks and organizes a solid filling or fillings skewered on a stick and covered with a batter, said device comprising a mold preferably constructed of non-stick material having a length slightly longer than a desired food product's length; a base to maintain said mold in an upright position; and a support to maintain said stick in an upright position; all said parts being microwaveable.

2. Said mold of claim 1 having a means of attachment of said stick in claim 1 to said mold in claim 1.

3. Said means of attachment of claim 2 being a Velcro pad and a felt pad located on an outer surface of said mold in claim 1, said Velcro pad and felt pad are frictionally engaged with a felt strap and a Velcro strap respectively, said Velcro strap and said felt strap overlap said stick in claim 1 and prevent said stick from moving.

4. Said device in claim 1 having a removable cap to prevent said batter of claim 1 from spilling out of said mold of claim 1 during storage.

5. Said support in claim 1 for said stick in claim 1 being an insert positioned in an uppermost portion of said mold in claim 1, said insert has one or a plurality of fossa on an underside of insert, said fossa frictionally engages said stick in claim 1 and prevents said stick from moving.

6. Said insert in claim 5 after modification capable being positioned in a lowermost portion of molding tube in claim 1, said insert has one or a plurality of fossa on said upperside of insert, said fossa frictionally engages a stick in claim 1 and prevents stick from moving.

7. A device for microwave oven use that simultaneously cooks and organizes a solid filling or fillings skewered on a stick and covered with a batter, said device comprising a stick with a removable end or ends, a mold constructed of non-stick material having a length slightly longer than a solid product skewered on said stick; a base to maintain said mold in an upright position; and a support to maintain said stick in an upright position; all said parts being microwaveable.

8. Said mold of claim 7 having a means of attachment of said stick in claim 7 to said mold of claim 7.

9. Said means of attachment of claim 8 being a Velcro pad and a felt pad located on an outside of said mold in claim 7, said Velcro pad and said felt pad are frictionally engaged with a felt strap and a Velcro strap respectively, said Velcro strap and felt strap overlap said stick in claim 7 and prevent said stick from moving.

10. Said device in claim 7 having a removable cap to prevent said batter in claim 7 from spilling out of said mold in claim 7 during storage.

11. Said support in claim 7 for said stick in claim 7 being a disc positioned in an uppermost portion of said mold in claim 7, said disc has one or a plurality of fossa on an underside of said disc, said fossa frictionally engages said stick in claim 7 and prevents said stick from moving.

12. Said disc in claim 11 after modification capable of being positioned in a lowermost portion of said mold in claim 7, said disc has one or a plurality of fossa on an upperside of said disc, said fossa frictionally engages said stick in claim 7 and prevents said stick from moving.

13. A device for microwave oven use that simultaneously cooks and organizes a solid filling or fillings skewered on a stick and covered with a batter, said device comprising a piercing structure that can be connected to a store bought candy stick or comparable material so as to form said stick, a mold preferably constructed of non-stick material having a length slightly longer than a desired food product's length; a base to maintain said mold in an upright position; and a support to maintain said stick in an upright position; all said parts being microwaveable.

14. Piercing structure of claim 13 having an alternative design with one or more sections being non-microwaveable so as to encourage said removal of said piercing structure prior to microwave cooking.

15. Said mold of claim 13 having a means of attachment of said stick of claim 13 to said mold.

16. Said means of attachment of claim 15 being a Velcro pad and a felt pad located on an outside of said mold in claim 13, said Velcro pad and said felt pad are frictionally engaged with a felt strap and a Velcro strap respectively, said Velcro strap and said felt strap overlap said stick in claim 13 and prevent said stick from moving.

17. Said device in claim 13 having a removable cap to prevent said batter of claim 13 from spilling out of said mold in claim 13 during storage.

18. Said support in claim 13 for said skewer in claim 13 being a disc positioned in an uppermost portion of mold in claim 13, said disc has one or a plurality of fossa on an underside of disc, said fossa frictionally engages said stick in claim 13 and prevents said stick from moving.

19. Said disc in claim 18 after modification capable of being positioned in a lowermost portion of said mold in claim 13, said disc has one or a plurality of fossa on an upperside of disc, said fossa frictionally engages said stick in claim 13 and prevents said stick from moving.

* * * * *